US005466743A

United States Patent [19]

Schamesberger

[11] Patent Number: 5,466,743

[45] Date of Patent: Nov. 14, 1995

[54] POLYETHYLENE-BASED SKI COATING

[75] Inventor: Robert Schamesberger, Eisenstadt, Austria

[73] Assignee: Isosport Verbundbauteile Gesellschaft m.b.H., Austria

[21] Appl. No.: 64,166

[22] PCT Filed: Sep. 30, 1992

[86] PCT No.: PCT/AT92/00123

§ 371 Date: May 27, 1993

§ 102(e) Date: May 27, 1993

[87] PCT Pub. No.: 93/06900

PCT Pub. Date: Apr. 15, 1993

[30] Foreign Application Priority Data

Oct. 3, 1991 [AT] Austria ..... 1981/91

[51] Int. Cl.[6] ..... C08K 5/02

[52] U.S. Cl. ..... 524/462; 280/601; 524/545; 524/546; 525/199

[58] Field of Search ..... 524/462, 545, 524/546; 525/199, 200; 280/601

[56] References Cited

U.S. PATENT DOCUMENTS

| | | | |
|---|---|---|---|
| 4,093,268 | 6/1978 | Sampson et al. | 280/610 |
| 4,310,588 | 1/1982 | Bareel | 428/251 |

FOREIGN PATENT DOCUMENTS

| | | | |
|---|---|---|---|
| 0049736 | 4/1982 | European Pat. Off. | A63C 5/12 |
| 0421303 | 4/1991 | European Pat. Off. | C09G 3/00 |
| 1728070 | 9/1967 | Germany | A63C 5/04 |
| 2748177 | 5/1979 | Germany | B29F 5/00 |

*Primary Examiner*—Peter D. Mulcahy
*Attorney, Agent, or Firm*—Bacon & Thomas

[57] ABSTRACT

The invention concerns a polyethylene-based ski coating containing up to 5%-wt of a fluorinated additive. This ski coating is especially suitable for making downhill and cross-country skis.

7 Claims, No Drawings

POLYETHYLENE-BASED SKI COATING

TECHNICAL FIELD

The invention concerns a polyethylene-based ski coating, further a method for its manufacture, and its applications.

Presently high requirements are placed on such ski coatings with respect to abrasion behavior, strength, toughness and sliding on snow.

STATE OF THE ART

Now it was found that on account of the non-polar nature of polyethylene, such ski coatings evince good hydrophobia and therefore a low frictional coefficient of sliding. These properties can be stated in the form of the so-called surface energy. The lower the value of the surface energy, the better the sliding on snow. These surface-energy values are very low for polyethylene and only fluoro-polymers are lower. Pure fluoro-polymers however are unsuited to some extent for making ski coatings because their surfaces can be worked only with difficulty using the conventional grinding means. But a ski-coating surface free of fibers and scales is especially important for ski racers.

Moreover fluoro-polymers such as polytetrafluoroethylene accept wax only to a moderate degree because the wax diffusion takes place exceedingly slowly because of high crystallinity.

DISCUSSION OF THE INVENTION

The object of the present invention is to create a ski coating evincing improved wax acceptance and improved sliding on snow compared with known ski coatings.

This problem is solved by the polyethylene-based ski coating of the invention which is characterized in that it contains up to 5%-wt of a fluorinated additive. This fluorinated additive advantageously may be based on a fluoro-oil, a fluoro-wax, a partly fluorinated hydrocarbon or a fluoro-polymer, because such additives increase the diffusion of ski waxes which are especially significant in ski racing.

Moreover the ski coating of the invention advantageously comprises a fluorine proportion of 0.01 to 2, preferably 0.5 to 1%-wt. This fluorine proportion assures problem-free post-processing of the ski surface, for example, using abradants.

The ski coating of the invention advantageously can be manufactured by adding up to 5%-wt of a fluorinated additive to the polyethylene-based ski-coating raw material prior to the known manufacturing procedure, such as screw extrusion, ram extrusion (stuffing) or pressure sintering. Because of the high melting points of fluorine compounds, they can also be used in high-temperature procedures, such as pressure sintering, without their structure being altered.

Furthermore the ski coating of the invention can be advantageously used for making downhill and cross-country skis. Because higher requirements are placed on the ski coatings of the invention when applied to downhill skis, especially as regards sliding on snow, than when used for cross-country skis, such differing requirements can be met in particular by adjusting the proportion of additive in the ski-coating raw material.

SEVERAL IMPLEMENTATIONS OF THE INVENTION

The invention is elucidated below in relation to the following illustrative implementations.

EXAMPLE 1

3%-wt polyvinylidene fluoride (PVDF) are added to high-density polyethylene (HDPE) with a mean molecular weight of 200,000, the HDPE and PVDF components being both granular in this mixture. This mixture is fed into a single-screw extruder at a material temperature of about 300° C. to form foils which shall be gauged in a subsequent calender. Thereupon the gauged foils are cut to the desired ski-coating width.

EXAMPLE 2

5%-wt PTFE (polytetrafluoroethylene) are added to ultra-high-molecular-weight polyethylene (UHMW-PE), the UHMW-PE and PTFE components being present in powder form in this mixture. A cross-sectionally shaped ski coating is manufactured from this powder mixture in a ram extruder (stuffer) at temperatures up to 360° C. and a pressure of about 1,000 bars, said cross-section being controllable by the shape of the extruder die.

EXAMPLE 3

3%-wt of a fluoro-wax are added to ultrahigh-molecular-weight polyethylene (UMWH-PE). This powder mixture is fed into a round mold and is cold-pressed at a pressure of about 100 bars. This round is then cooled for about 8 hours and under pressure down to room temperature. The subsequent peeling determines the thickness of the ski coating.

COMMERCIAL APPLICABILITY

This ski coating is especially suitable for making downhill and cross-country skis.

I claim:

1. A snow ski coating comprising polyethylene with a slide enhancing amount up to 5% by weight of the coating of a fluorinated additive incorporated therein such that the coating contains a proportion of fluorine from 0.01 to 2% by weight of the coating.

2. Ski coating defined in claim 1, wherein the ski coating contains a fluorinated additive based on a partly fluorinated hydrocarbon.

3. Ski coating defined in claim 1, wherein the ski coating contains a fluoro-polymer based additive.

4. Ski coating defined in claim 1, wherein the ski coating contains a proportion of fluorine from 0.5 to 1% by weight of the coating.

5. A method for manufacturing a ski coating defined in claim 1, wherein a fluorinated additive in a proportion up to 5%-wt is added to the polyethylene-based ski coating before the manufacture by screw extrusion, ram extrusion or pressure sintering.

6. A downhill ski comprising the coating as defined in claim 1.

7. A cross-country ski comprising the coating as defined in claim 1.

* * * * *